US007538644B2

(12) United States Patent
Oh

(10) Patent No.: US 7,538,644 B2
(45) Date of Patent: May 26, 2009

(54) MULTI-POLE CIRCUIT BREAKER

(75) Inventor: Ki-Hwan Oh, Chungcheongkuk-Do (KR)

(73) Assignee: LS Industrial Systems Co., Ltd., Seoul (KR)

( * ) Notice: Subject to any disclaimer, the term of this patent is extended or adjusted under 35 U.S.C. 154(b) by 255 days.

(21) Appl. No.: 11/534,857

(22) Filed: Sep. 25, 2006

(65) Prior Publication Data

US 2007/0075047 A1 Apr. 5, 2007

(30) Foreign Application Priority Data

Oct. 4, 2005 (KR) ..... 10-2005-0093135

(51) Int. Cl.
*H01H 75/00* (2006.01)
*H01H 77/00* (2006.01)
*H01H 83/00* (2006.01)

(52) U.S. Cl. ..... 335/8; 335/6; 335/14; 335/22; 335/85; 335/89; 335/106; 335/112; 335/189; 335/190; 335/194; 335/167

(58) Field of Classification Search ..... 335/6, 335/8–11, 14, 22, 85, 89, 106, 112, 189, 335/190, 194, 167–176
See application file for complete search history.

(56) References Cited

U.S. PATENT DOCUMENTS 3,752,947 A 8/1973 Strobel
5,298,874 A * 3/1994 Morel et al. ..... 335/8
5,313,180 A * 5/1994 Vial et al. ..... 335/16
6,459,059 B1 10/2002 Greenberg et al.
6,639,168 B1 * 10/2003 Castonguay et al. ..... 218/22
7,148,775 B2 * 12/2006 Park ..... 335/16
2002/0153978 A1 * 10/2002 Greenberg et al. ..... 335/8
2005/0231308 A1 * 10/2005 Kim ..... 335/16
2006/0119455 A1 6/2006 Park
2006/0131145 A1 6/2006 Suh

FOREIGN PATENT DOCUMENTS

EP 1003192 5/2000
EP 1600988 11/2005
WO 082487 10/2002

OTHER PUBLICATIONS

U.S. Appl. No. 11/467,648, filed Aug. 28, 2006, Song.
U.S. Appl. No. 11/535,183, filed Sep. 26, 2006, Ahn.

* cited by examiner

*Primary Examiner*—Elvin G Enad
*Assistant Examiner*—Mohamad A Musleh
(74) *Attorney, Agent, or Firm*—Greenblum & Bernstein, P.L.C.

(57) ABSTRACT

Disclosed is a multi-pole circuit breaker. The multi-pole circuit breaker includes: a substrate disposed between the single pole breaking unit, spaced relatively far from the switching mechanism as compared to the other single pole breaking units among the plurality of single breaking units, and the adjacent single pole breaking unit; a link mechanism rotatably supported on the substrate; and springs having one ends supported by the substrate and the other ends supported by the link mechanism.

8 Claims, 12 Drawing Sheets

MULTI-POLE CIRCUIT BREAKER

BACKGROUND OF THE INVENTION

1. Field of the Invention

The present invention relates to a multi-pole circuit breaker, and more particularly, to a multi-pole circuit breaker, which can ensure the equilibrium of contact forces between contactors in a single pole breaking unit relatively far from a switching mechanism and the reliability of a switching operation between the contactors.

2. Description of the Conventional Art

In general, a circuit breaker is an electrical device that protects a load and a line by manually or automatically breaking the line in the event of an abnormal condition such as an overload and short-circuiting of the line.

FIG. 1 is a perspective view illustrating a conventional multi-pole circuit breaker. FIG. 2 is an exploded perspective view illustrating a conventional multi-pole circuit breaker. FIG. 3 is a side view illustrating a conventional multi-pole circuit breaker. FIG. 4 is a perspective view showing the deformation of a driving shaft in a conventional multi-pole circuit breaker.

As illustrated in FIGS, 1 to 4, the conventional multi-pole circuit breaker 1 includes four single pole breaking units 10*a*, 10*b*, 10*c*, and 10*d*, that is, a single pole breaking unit 10*a* of R phase, a single pole breaking unit 10*b* of S phase, a single pole breaking unit 10*c* of T phase, and a single pole breaking unit 10*d* of N phase.

Each of the single pole breaking units includes a case 20 having a space, a plurality of contactors 40 including fixed contactors 41 installed in the case 20 with a predetermined distance and a movable contactor 42 rotatably disposed between the fixed contactors 41 by shafts 53, a trip mechanism (not shown) for tripping the circuit breaker by detecting a large current flowing through the circuit, a switching mechanism 50 automatically operated by the trip mechanism or manually operated by operating a handle 51, for separating the movable contactor 42 from the fixed contactors 41 thereby cutting off a circuit, and an arc extinguishing mechanism 60 for extinguishing arc gas of a high temperature and a high pressure generated between movable contactor 42 and the fixed contacts 41 at the time of switching a circuit.

The switching mechanism 50 includes a handle 51, an upper link (not shown) coupled to the trip mechanism, a lower link (not shown) coupled in conjunction with the lower part of the upper link, and driving shafts 52 for commonly connecting the lower link and the shaft 53 of each single pole breaking unit so that the shaft 53 of each single pole breaking unit can rotate in conjunction with the lower link.

In the thus-constructed conventional multi-pole circuit breaker, when a normal current flows on a circuit, the movable contactor 42 is in contact with fixed contactors 41 thereby to maintain a closed circuit state.

On the other hand, when a large current flows on the circuit abnormally while a circuit is in an ON state, the circuit breaker is tripped, At this time, the upper link and the lower link are rotated. As the lower link is rotated, the shaft 53 coupled thereto through the driving shaft 52 rotates in a clockwise direction. At this time, the movable contactor 42 is separated from the fixed contactors 41 to thereby maintain an opened circuit state.

However, in the conventional multi-pole circuit breaker, the switching mechanism 50 is not installed at the middle of the circuit breaker but installed biased to one side, that is to say, at the single pole breaking unit 10*b* of S phase corresponding to the second right one, as illustrated in FIGS. 1 and 2, of the four single pole breaking units 10*a*, 10*b*, 10*c*, and 10*d* to thereby make unbalanced the force applied to each of the single pole breaking units 10*a*, 10*b*, 10*c*, and 10*d* by the switching mechanism 50.

Subsequently, there occurs a problem that, as shown in FIG. 4, end portions of the driving shafts 52 are deformed as they are bent in a clockwise direction. Hence, the shaft installed at the single pole breaking unit 10*d* of N phase has a smaller amount of rotation as compared to the shafts installed at the other single pole breaking units 10*a*, 10*b*, and 10*c*, and as a result, the contact and separation performance between the fixed contactors 41 and the movable contactor 42 and the reliability of the product are deteriorated.

SUMMARY OF THE INVENTION

Therefore, the present invention has been made in an effort to solve the above-described problems, and has for its object to provide a multi-pole circuit breaker, which can ensure the equilibrium of contact forces between contactors in a single pole breaking unit relatively far from a switching mechanism and the reliability of a switching operation between the contactors.

Accordingly, there is provided a multi pole circuit breaker in accordance with the present invention, which includes: a plurality of single pole breaking units having a pair of fixed contactors, a movable contactor rotatable to a contacted position to fixed contactors or a separated position from the fixed contactors, and shafts for rotatably supporting the movable contactor; a switching mechanism disposed on one of the plurality of single pole breaking units in order to provide a rotation force to the shafts; and a pair of driving shafts commonly connected to the shafts in order to simultaneously transmit a rotation force from the switching mechanism to the shafts of the plurality of single pole breaking units, including: a substrate disposed between the single pole breaking unit, spaced relatively far from the switching mechanism as compared to the other single pole breaking units among the plurality of single breaking units, and the adjacent single pole breaking unit; a link mechanism rotatably supported on the substrate, for providing a compensating rotation moment to the driving shafts so that a contact force between the contactors in the single pole breaking unit relatively far from the switching mechanism may not be smaller than a contact force between the contactors in the other single pole breaking units; and springs having one ends supported by the substrate and the other ends supported by the link mechanism, for providing an elastic force to the link mechanism for the provision of the compensating rotation moment.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

A multi-pole circuit breaker in accordance with preferred embodiments of the present invention will be described in detail with reference to the accompanying drawings.

Figure 5:
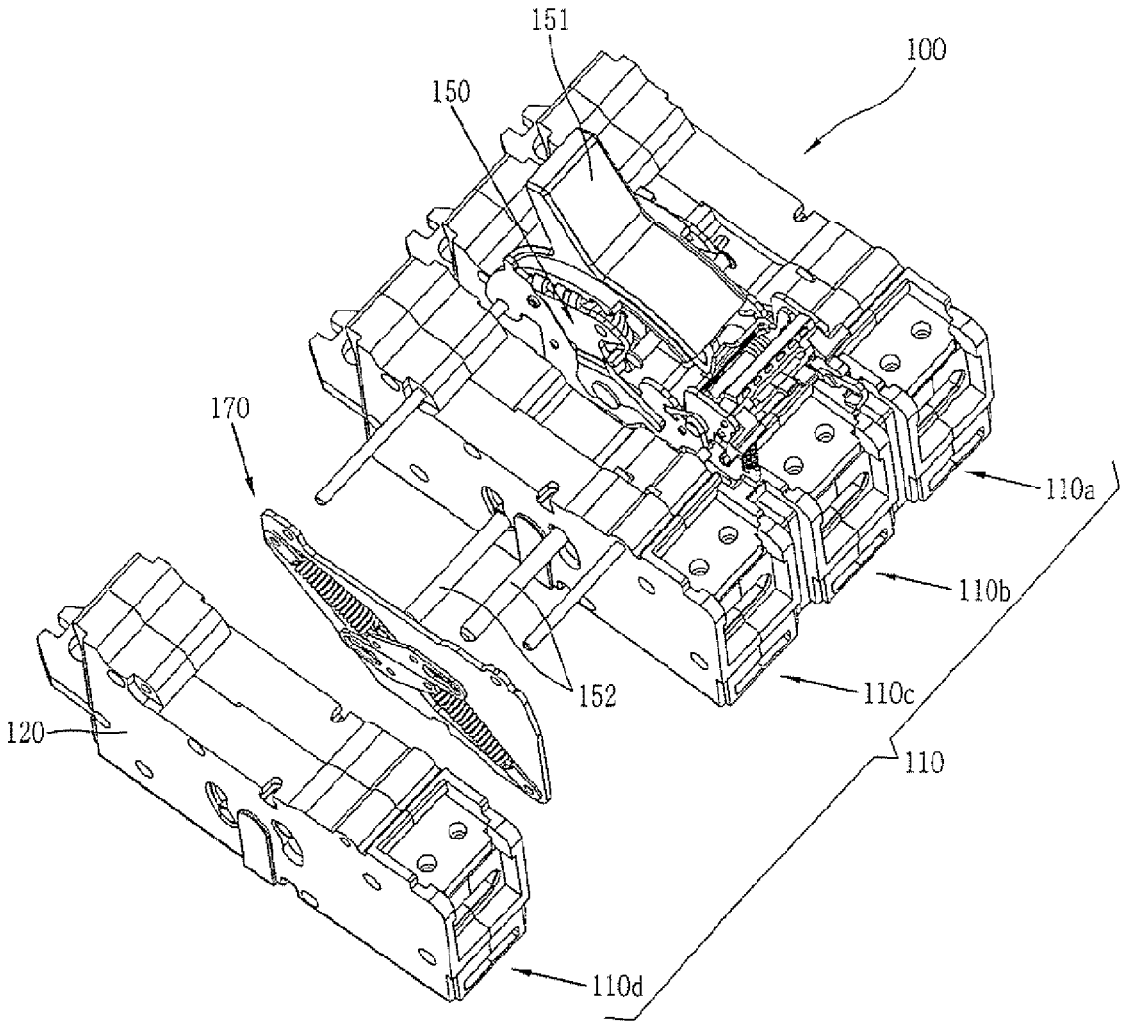
FIG. 5 is an exploded perspective view showing a multi-pole circuit breaker in accordance with one embodiment of the present invention.
Figure 6:
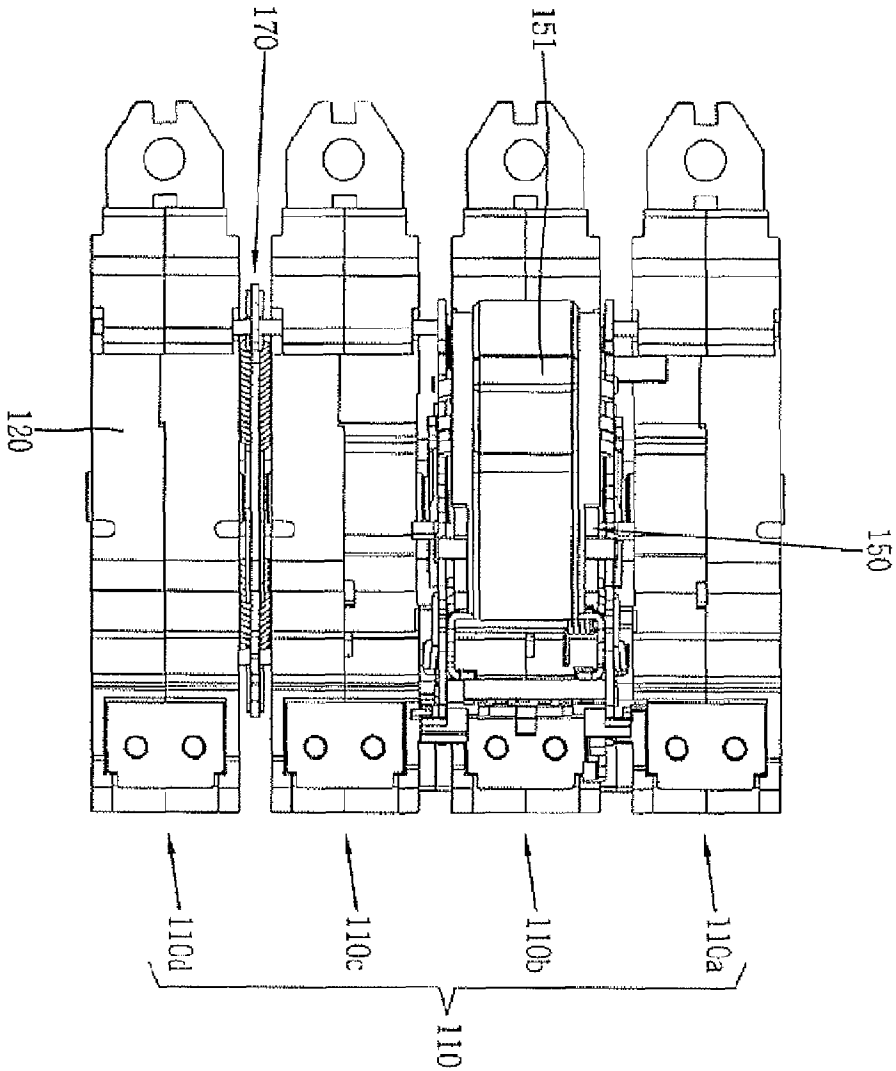
FIG. 6 is a plane view showing a multi-pole circuit breaker in accordance with one embodiment of the present invention.
Figure 7:
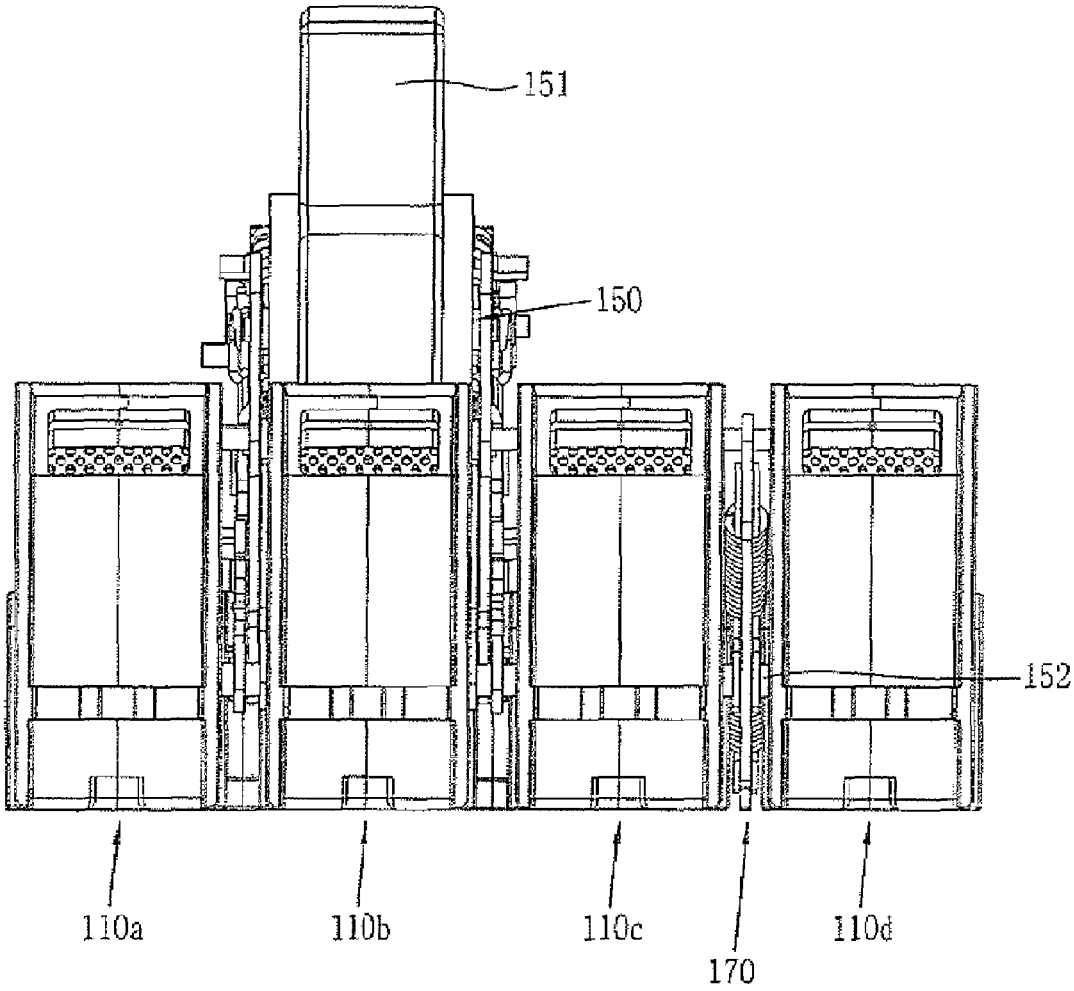
FIG. 7 is a side view showing a multi-pole circuit breaker in accordance with one embodiment of the present invention.
Figure 8:
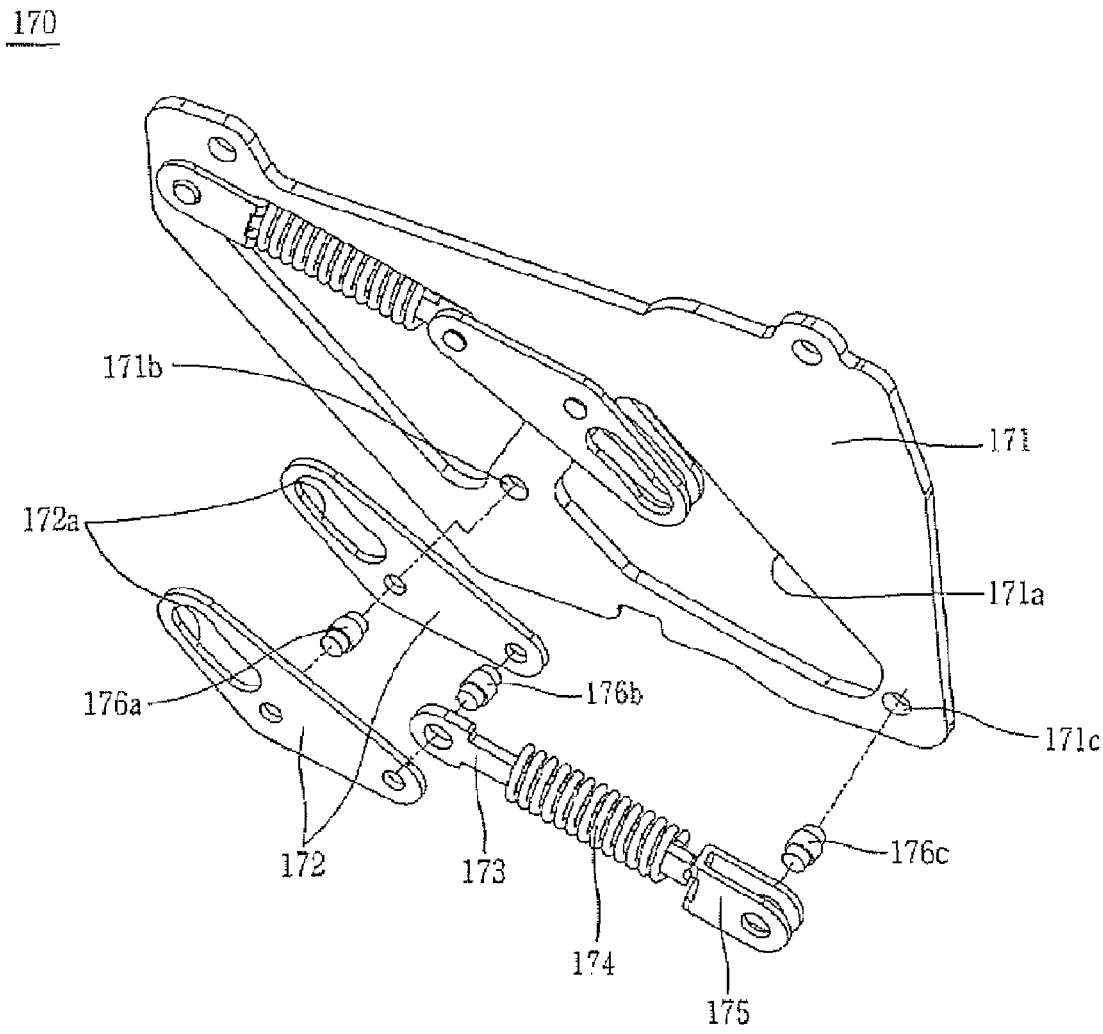
FIG. 8 is an exploded perspective view showing an auxiliary mechanism in a multi-pole circuit breaker in accordance with one embodiment of the present invention.
Figure 9:
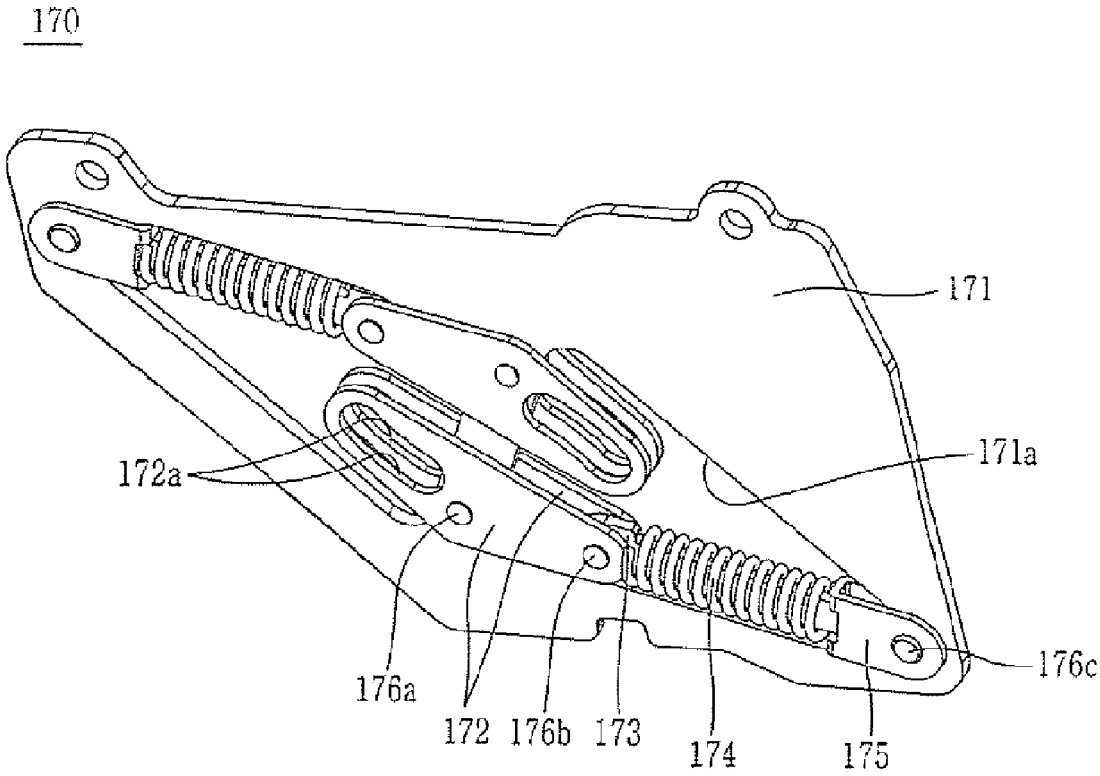
FIG. 9 is a coupled perspective view showing an auxiliary mechanism in a multi-pole circuit breaker in accordance with one embodiment of the present invention.

FIG. 5 is an exploded perspective view showing a multi-pole circuit breaker in accordance with one embodiment of the present invention. FIG. 6 is a plane view showing a multi-pole circuit breaker in accordance with one embodiment of the present invention. FIG. 7 is a side view showing a multi-pole circuit breaker in accordance with one embodiment of the present invention. FIG. 8 is an exploded perspective view showing an auxiliary mechanism in a multi-pole circuit breaker in accordance with one embodiment of the present invention. FIG. 9 is a coupled perspective view showing an auxiliary mechanism in a multi-pole circuit breaker in accordance with one embodiment of the present invention;

As illustrated therein, the multi-pole circuit breaker 100 in accordance with the present invention is a circuit breaker for four poles (so-called four phases), and includes a circuit breaker body 110 consisting of four phase-based single pole breaking units 110*a* to 110*d* of R phase (so-called R pole), S phase (so-called S pole), T phase (so-called T pole), and N phase (so-called N pole), i.e., a R-phase single pole circuit breaking unit 110*a*, a S-phase single pole breaking unit 110*b*, a T-phase single pole breaking unit 110*c*, and an N-phase single pole breaking unit 110*d* from top down.

A switching mechanism 150 is disposed on the S-phase single pole breaking unit 110*b*. A handle 151 for manually switching the position of the switching mechanism, i.e., from an ON position to OFF position or from the OFF position to the ON position, is disposed on the top portion of the switching mechanism 150, being connected to the switching mechanism 150.

Figure 2:
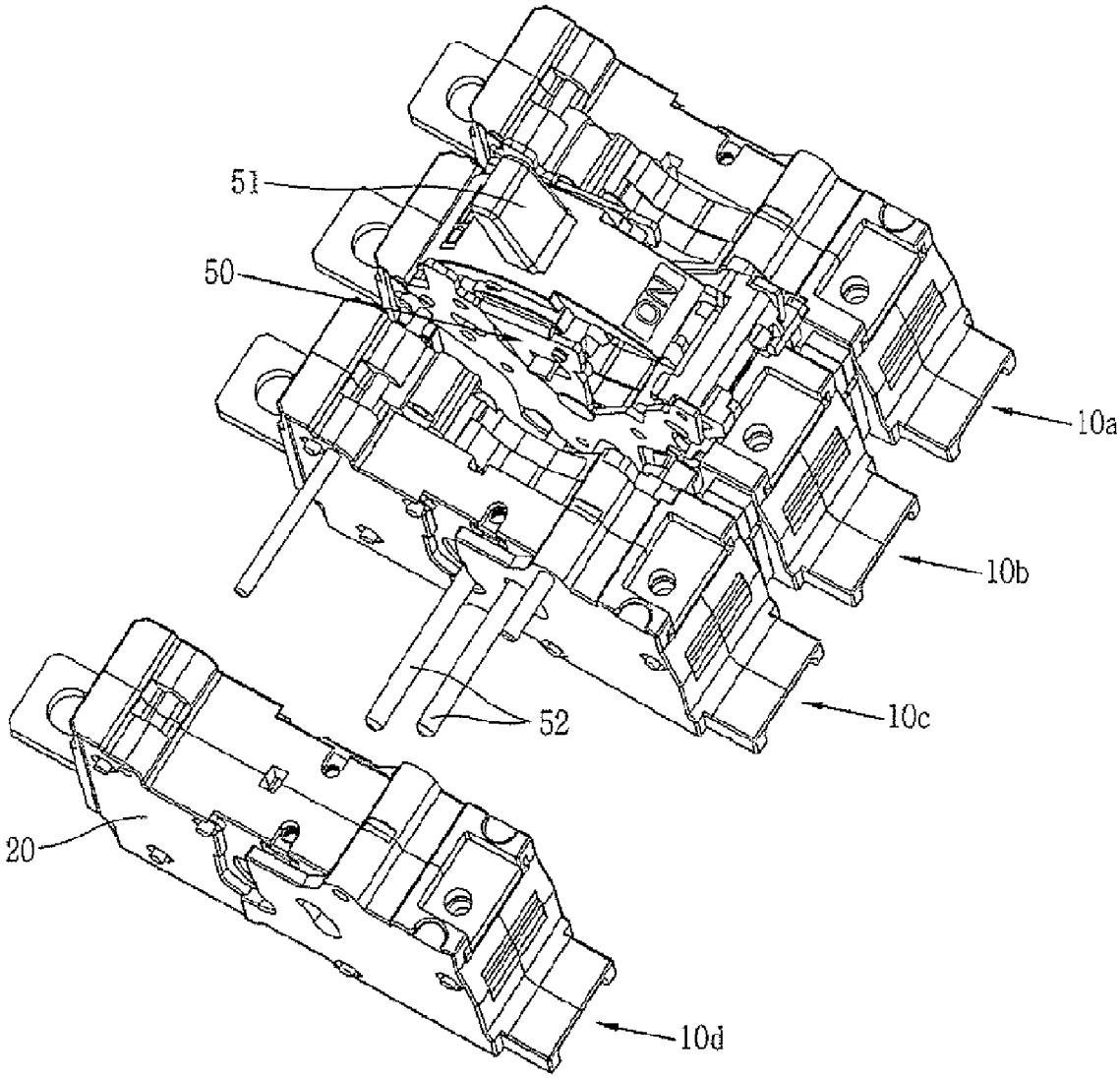
FIG. 2 CONVENTIONAL ART
FIG. 2 is an exploded perspective view illustrating a conventional multi-pole circuit breaker.
Figure 3:
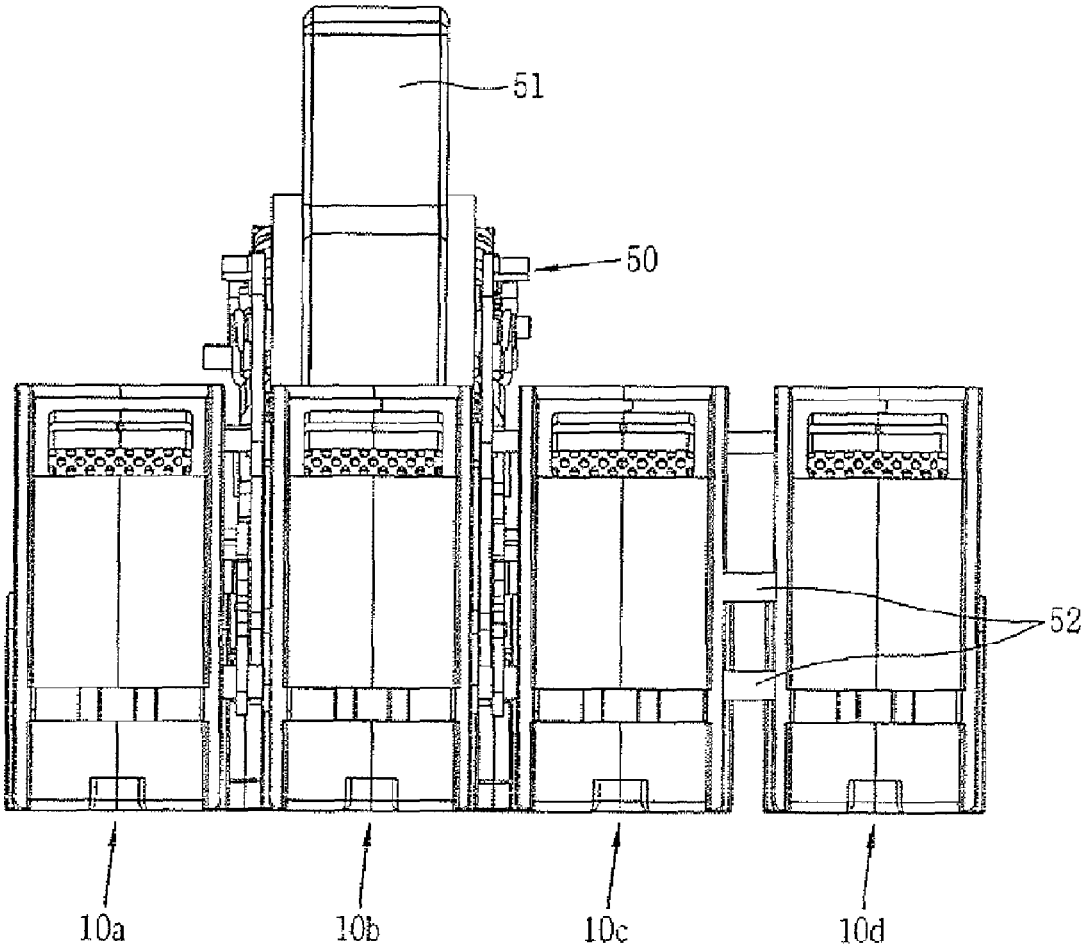
FIG. 3 CONVENTIONAL ART
FIG. 3 is a side view illustrating a conventional multi-pole circuit breaker.
Figure 4:
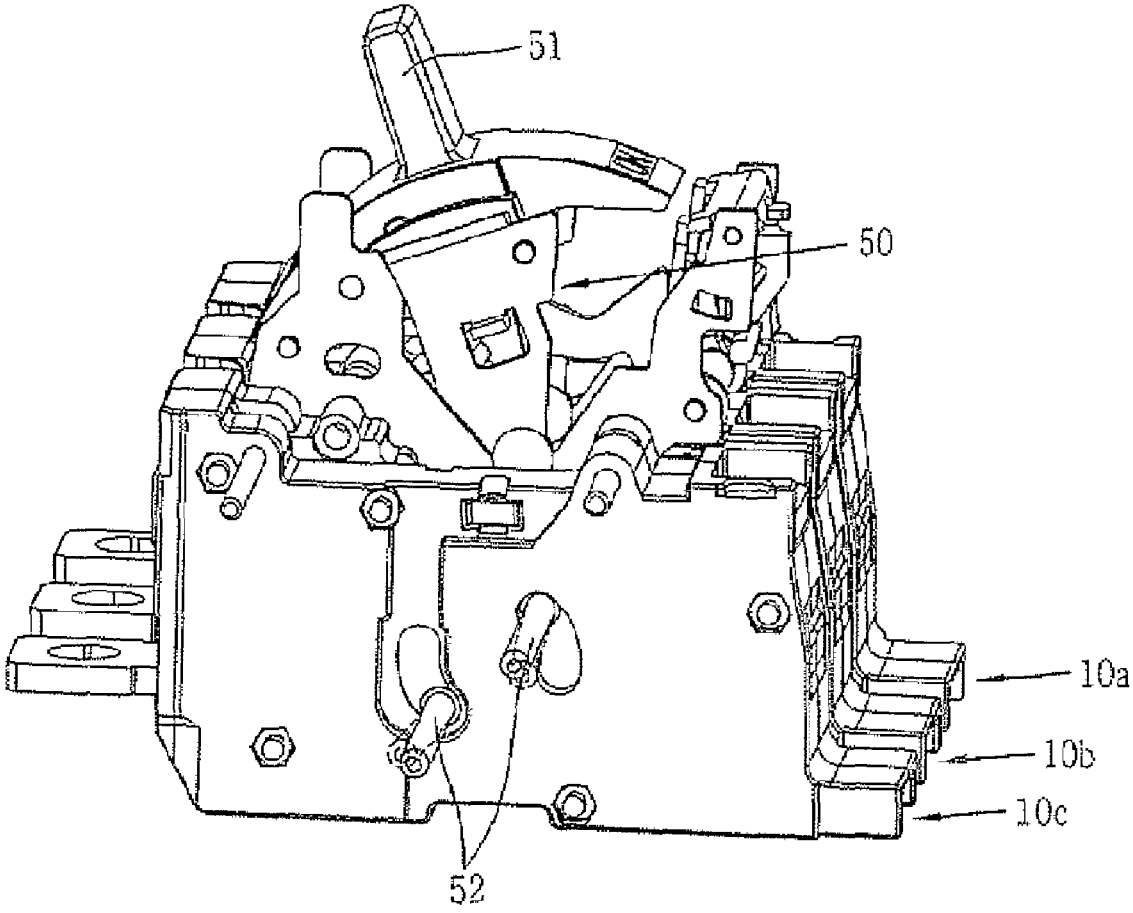
FIG. 4 CONVENTIONAL ART
FIG. 4 is a perspective view showing the deformation of a driving shaft in a conventional multi-pole circuit breaker.

A pair of driving shafts 152 is connected to shafts (53 of FIG. 2) in the single pole breaking units 110*a* to 10*d* of the respective phases in order to simultaneously transmit a driving force of the switching mechanism 150 to the single pole breaking units 110*a* to 110*d* of the respective phases.

Between the T-phase single pole breaking unit 110*c* and the N-phase single pole breaking unit 110*d*, according to the present invention, an auxiliary mechanism 170 is disposed, which is disposed between the N-phase single pole breaking unit 110*d*, relatively far from the switching mechanism 150, and the adjacent T-phase single pole breaking unit 110*c*, and provides a compensating rotation moment to the driving shafts 152.

Unexplained reference numeral 120 is a case made of an electrical insulating material of each of the single pole breaking units 110*a* to 110*d*.

As illustrated in FIGS. 6 and 7 the auxiliary mechanisms 170 is disposed between the N-phase single pole breaking unit 110*d*, relatively far from the switching mechanism 150 among the plurality of single breaking units 110*a* to 110*d*, and the adjacent T-phase single pole breaking unit 110*c*.

As illustrated in FIGS. 8 and 9, the auxiliary mechanism 170 in accordance with one embodiment of the present invention includes a substrate 171 disposed between the N-phase single pole breaking unit, relatively far from the switching mechanism 150 as compared to the other single pole breaking units among the plurality of single breaking units 110*a* to 110*d*, and the adjacent T-phase single pole breaking unit 110*c*.

A pair of opening 171*a* is prepared at the left and right sides, respectively, of the substrate 171 in order to permit the passage and rotation of the pair of driving shafts 152 and the rotation of a link mechanism 172, 173, 175, 176*a*, 176*b*, and 176*c* (refer to FIG. 5). Rotation axis holes 171*b* for supporting a pair of hinge pins 176*a* rotatably supporting two sets of a pair of coupling links 172 to be described later are prepared at the top and bottom, respectively, of a central cylindrical portion of the substrate 171 that divides the pair of openings 171*a* into left and right parts.

The link mechanism 172, 173, 175, 176*a*, 176*b*, 171*c*and 176*c* to be included in the auxiliary mechanism 170 is rotatably supported on the substrate 171, and provides a compensating rotation moment to the driving shafts (152 of FIG. 5) so that a contact force between the movable contactor (42 of FIG. 2) and the fixed contactors (41 of FIG. 2) in the N-phase single pole breaking unit 110*d*, relatively far from the switching mechanism 150, may not be smaller than a contact force between the movable contactor and the fixed contactors in the other single pole breaking units 110*a* to 110*c*.

Springs 174 to be included in the auxiliary mechanism 170 have one ends supported by the substrate 171 and the other ends supported by a supporting link 173, which is to be described hereinafter in more detail, among the link mechanism 172, 173, 175, 176*a*, 176*b*, and 176*c*, for providing an elastic force for the provision of the compensating rotation moment.

The link mechanism in accordance with one embodiment of the present invention includes: coupling links 172 provided with guide slots 172*a* for relatively movably receiving the driving shafts 152, and relatively rotatably coupled to the substrate 171 so as to have an axial line along the thickness direction thereof, for providing a compensating rotation moment to the driving shafts 152; and a supporting link 173 having one ends relatively rotatably coupled to the coupling links 172 and the other ends relatively rotatably supported by the substrate, for providing an elastic force from the springs 174 for rotation to the coupling links 172.

The link mechanism further includes supporting members 175 for supporting the other end of the supporting link 173 so as to be rotatable relative to the substrate 171 while supporting the other ends of the springs 174.

The coupling links 172 are prepared in two sets of upper and lower coupling links corresponding to the pair of driving shafts 152. Each set of the coupling links 172 consists of a pair of coupling links 172. The coupling links 172 have central axis holes, respectively, at a longitudinal center portion, the guide slots 172*a* are prepared at one ends around the central axis holes, and connecting axial holes for connecting to the supporting links 173 are prepared at opposite ends thereof. Therefore, one set of the pair of connection links 172 is supported so as to be only rotatable by the hinge pins 176*a* inserted through the central axis holes with the substrate 171 disposed therebetween.

The supporting links are arrow-shaped members, whose head portions having a larger width than the other portions are provided with connection holes for connecting to the coupling links 172 and connected to the coupling links 172 by connection axes 176*b*, whose body portions have the springs 174 disposed thereon, and whose leg portions are inserted into supporting holes prepared at the front side of the supporting members 175 and supported by the supporting members 175 so as to be movable back and forth along the longitudinal direction.

One ends of the springs 174 are supported by the supporting members 175, and the other ends thereof are supported by the head portions.

The supporting members 175 are U-shaped members, and from a longitudinal standpoint, have the supporting holes at the front side and rotation axis holes for inserting hinge axes 176*c* therein, so the hinge axes 176*c* supported on the corners of the left and right openings 171*a* of the substrate 171 are inserted into the rotation axis holes and made rotatable around the hinge axes 176*c*. The other ends of the springs 174 provide an elastic bias force to the head portion of the supporting links 173 so that the supporting links 173 may move forward along the longitudinal direction. The head portions of the supporting links 173 are connected to the connection links 172 by the connection axes 176*b*, and the coupling links 172 are supported by the hinge axes 176*c* so as to be only rotatable relative to the substrate 171, thus a linear force by which the supporting links 175 are to move forward along the longitudinal direction by the springs 174 acts as a rotation driving force of the coupling links 172, thereby rotating the coupling links 172. As a result, an elastic bias force of the springs 174 acts as a compensating rotation moment of the driving shafts 152 held in a manner to pass through the guide slots 172*a* of the coupling links 172.

In the meantime, the N-phase single pole breaking unit 110*d* is a single pole breaking unit that serves to switch a grounding system. If the N-phase single pole breaking unit 110*d* is switched to an ON state according to the international standards for electrical safety, contacts of the movable contactors and fixed contactors therein have to be contacted with each other prior to those in the other three-phase (R phase, S phase, and T phase) single pole breaking units 110*a*, 10*b*, 10*c*, and 110*d*. On the contrary, if the N-phase single pole breaking unit 110*d* is switched to a trip (or OFF) state, the movable contactor and fixed contactors therein need to be separated from each other later than those in the other three-phase (R phase, S phase, and T phase) single pole breaking units 110*a*, 110*b*, 110*c*, and 110*d*.

In a case where the switching mechanism 150 of the circuit breaker is switched from the ON state to the trip or OFF state, a critical rotation point of the coupling links 172 is set in such a manner that the intervals rotated by the elastic bias force of the springs 174 of the auxiliary mechanism 170 for providing a compensating rotation moment to the driving shafts 152 are relatively longer than the intervals rotated by a pressure received from the driving shafts 152 as the driving shafts 152 are moved by the rotation driving of the switching mechanism 150.

That is, when switching between the contacts of the movable contactor and fixed contactors in the N-phase single pole breaking unit 110*d* is carried cut, the time point of switching the driving force from the switching mechanism 150 to the auxiliary mechanism 170 can be adjusted by the critical rotation points of the coupling links 172. Thus, the critical rotation points of the coupling links 172 can be adjusted by changing the shape of the coupling links 172 and the position of the rotation central axes, i.e., the hinge axes 176*a*, or the shape of the guide slots 172*a* and the position of the point of inflection of the guide slots 172*a*.

The operation of the thus-constructed multi-pole circuit breaker kin accordance with one embodiment of the present invention will be described below.

Figure 10:
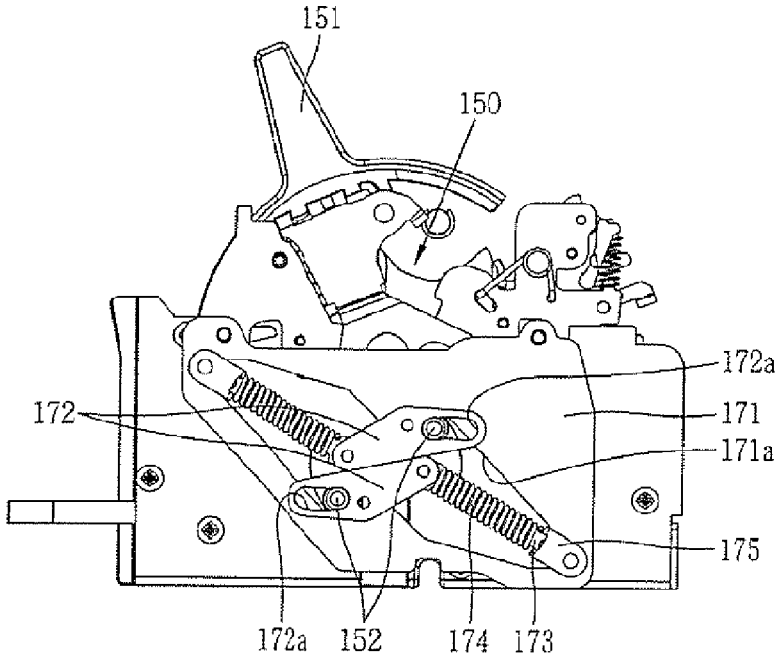
FIG. 10 is a front view showing the operation of an auxiliary mechanism when a switching mechanism is operated to an ON position in a multi-pole circuit breaker in accordance with one embodiment of the present invention.
Figure 11:
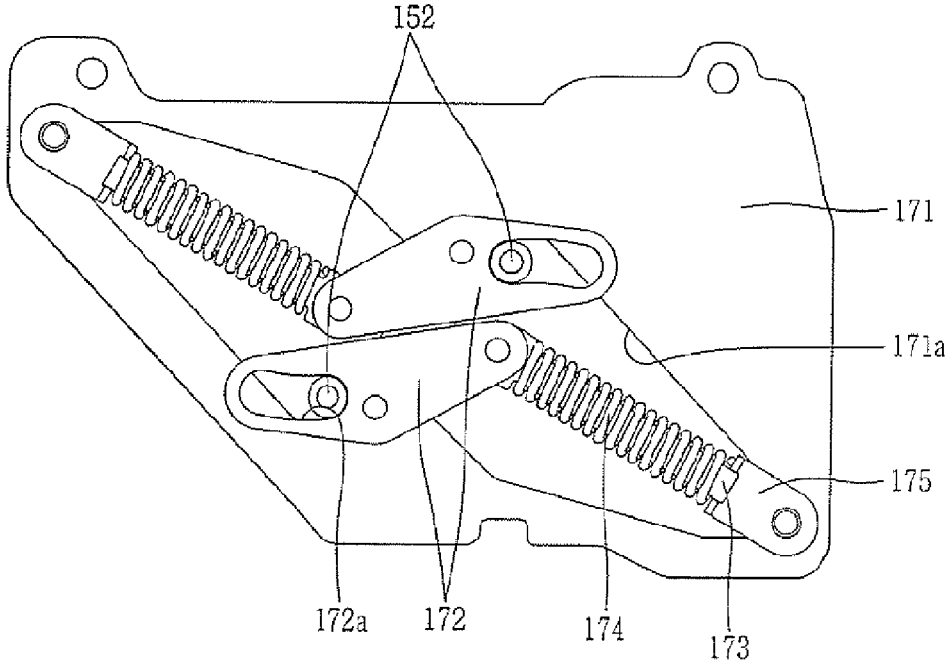
FIG. 11 is an enlarged view of essential parts of FIG. 10.
Figure 12:
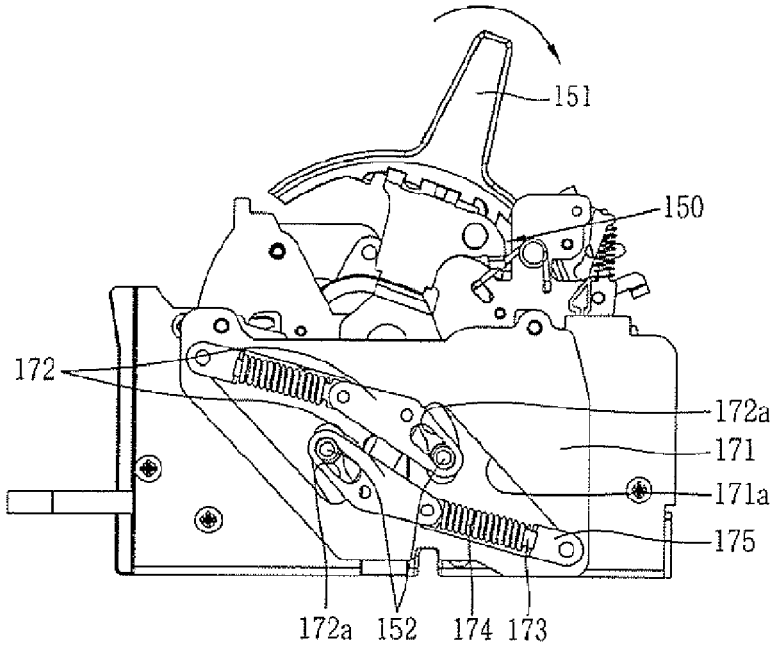
FIG. 12 is a front view showing the operation of an auxiliary mechanism when a switching mechanism is operated to an OFF position in a multi-pole circuit breaker in accordance with one embodiment of the present invention.
Figure 13:
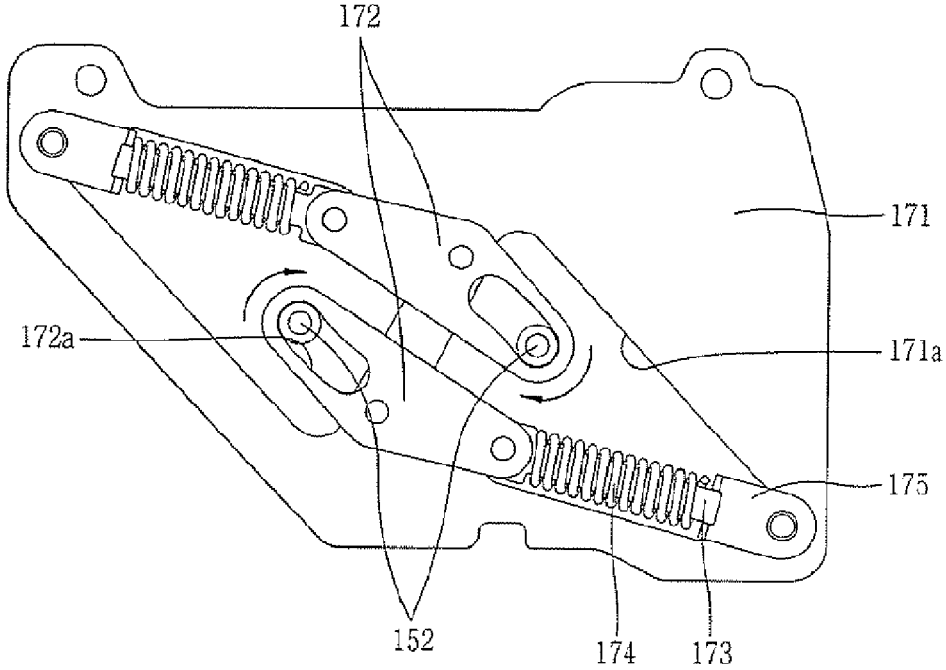
FIG. 13 is an enlarged view of essential parts of FIG. 12.

When the circuit breaker enters into the trip (or OFF) state as shown in FIG. 10 from the ON state as shown in FIG. 10 due to the generation of an over current or shot-circuit current, the driving shafts 152 coupled to the switching mechanism 150 are rotated in a clockwise direction along with the rotation driving of the switching mechanism 150, and at the same time, each of the coupling links 172 of the auxiliary mechanism 170 is rotated in a clockwise direction in conjunction with the driving shafts 152.

As each of the coupling links 172 is rotated each of the springs 174 of the auxiliary mechanism 170 applies an elastic force to the coupling links 172 in the counterclockwise direction for maintaining the ON state. Then, after each of the coupling links 172 is rotated to a predetermined position corresponding to the critical rotation points, the direction of the elastic force applied to the coupling links 172 by the springs 174 are reversed to the clockwise direction, thereby implementing the rotation of the coupling links 172 subsequent to the critical rotation points by the elastic force from the springs 174.

Figure 1:
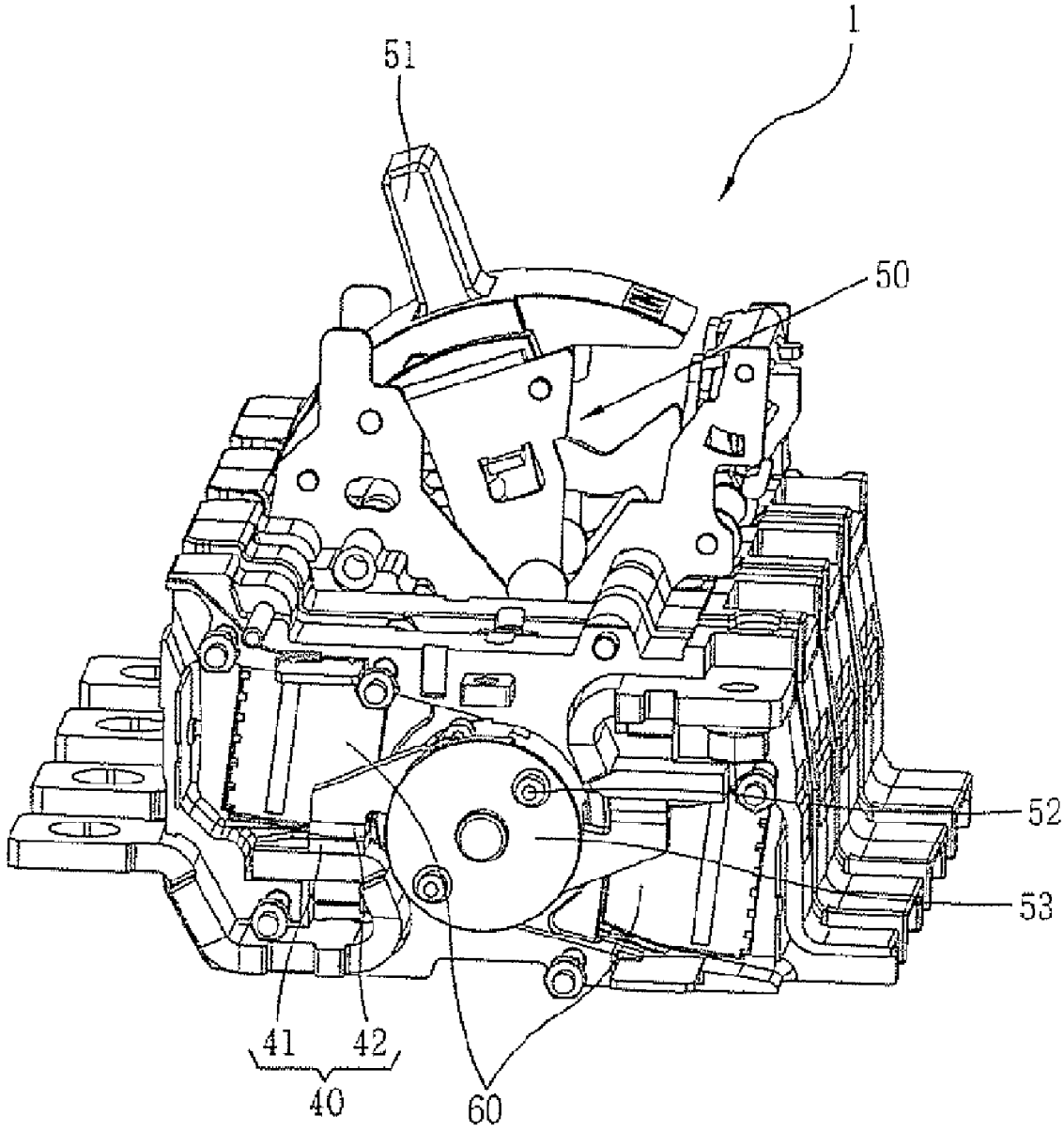
FIG. 1 CONVENTIONAL ART
FIG. 1 is a perspective view illustrating a conventional multi-pole circuit breaker.

The regions of the driving shafts 152 to which the coupling links 172 are connected are rotated by the compensating rotation moment from the coupling links 172 elastically rotated by the springs 174, and make it possible to correct the unbalance of the rotation driving force of the driving shafts 152 caused by the switching mechanism 150 of the four pole circuit breaker being biased from the center of the circuit breaker body 110. At this point, the shafts (refer to 52 of FIG. 2) of the single pole breaking units 110*a*, 110*b*, 110*c*, and 110*d* connected to the driving shafts 152 are rotated in a clockwise direction, and the movable contactor (refer to 42 of FIG. 1) is spaced apart from the fixed contactors (refer to 41 of FIG. 2), thereby separating the contacts.

Meanwhile, when the circuit breaker is manipulated from the trip (or OFF) state as shown in FIG, 11 to the ON state as shown in FIG. 10 by the user's manipulation of the handle, the driving shafts 152 coupled to the switching mechanism 150 are rotated in an counterclockwise direction along with the rotation driving of the switching mechanism 150, and at the same time, the coupling links 172 of the auxiliary mechanism 170 are rotated in the counterclockwise direction in conjunction with the driving shafts 152.

As each of the coupling links 172 is rotated in the counterclockwise direction, each of the springs 174 of the auxiliary mechanism 170 applies an elastic force to the coupling links 172 in the clockwise direction for maintaining the OFF or trip state. Then, after each of the coupling links 172 is rotated to a predetermined position corresponding to the critical rotation points, the direction of the elastic force applied to the coupling links 172 by the springs 174 are reversed to the counterclockwise direction, thereby implementing the rotation of the coupling links 172 subsequent to the critical rotation points by the elastic force from the springs 174.

The regions of the driving shafts 152 to which the coupling links 172 are connected are rotated by the compensating rotation moment from the coupling links 172 elastically rotated by the springs 174, and make it possible to correct the unbalance of the rotation driving force of the driving shafts 152 caused by the switching mechanism 150 of the four pole circuit breaker being biased from the center of the circuit breaker body 110. At this point, the shafts (refer to 52 of FIG. 2) of the single pole breaking units 110*a*, 110*b*, 110*c*, and 110*d* connected to the driving shafts 152 are rotated in a counterclockwise direction, and the movable contactor (refer to 42 of FIG. 1) is contacted with the fixed contactors (refer to 41 of FIG. 1), thereby closing the contacts.

As above, in the multi-pole circuit breaker in accordance with one embodiment of the present invention, by compensating for the rotation driving force, applied to the single pole breaking units 110*a*, 110*b*, 110*c*, and 110*cd* from the switching mechanism 150, in terms of balance by means of the auxiliary mechanism 170, the regions of the driving shafts 142 corresponding to the N-phase single pole breaking unit 110*d* relatively farthest away from the switching mechanism 150 can be prevented from deformation, and the amount of rotation of the shafts (52 of FIG. 2) disposed at the N-phase single pole breaking unit 110*d* can be made almost the same as those of the shafts (52 of FIG. 2) of the other three-phase (R, S, and T phases) single pole breaking units 110*a*, 110*b*, and 110*c*. This enables the contactors (41 and 42 of FIG. 2) of the N-phase single pole breaking unit 110*d* to be contacted with each other with a sufficient contact force, and thus prevents heat generation caused by degraded reliability and incomplete contact.

Moreover, the critical rotation points of the coupling links 172 at which the rotation driving force of the coupling links 172 is switched from the switching mechanism 150 to the auxiliary mechanism 170 are set in such a manner that if the N-phase single pole breaking unit 110*d* serving as a grounding system is switched to the ON state, the contacts thereof are coupled prior to those of the other three-phase (R, S, and T phases) single pole breaking units 110*a*, 110*b*, and 110*c*, and in contrast, if the N-phase single pole breaking unit 110*d* serving as a grounding system is switched to the trip (or OFF state), the contacts thereof are separated from each other later than those of the other three phase (R, S, and T phases) single pole breaking units 110*a*, 110*b*, and 110*c*. By this construction, the ground is connected (input) first at the time of power input, and the ground is disconnected (cut off) last at the time of tripping, thereby improving safety and reliability.

Figure 14:
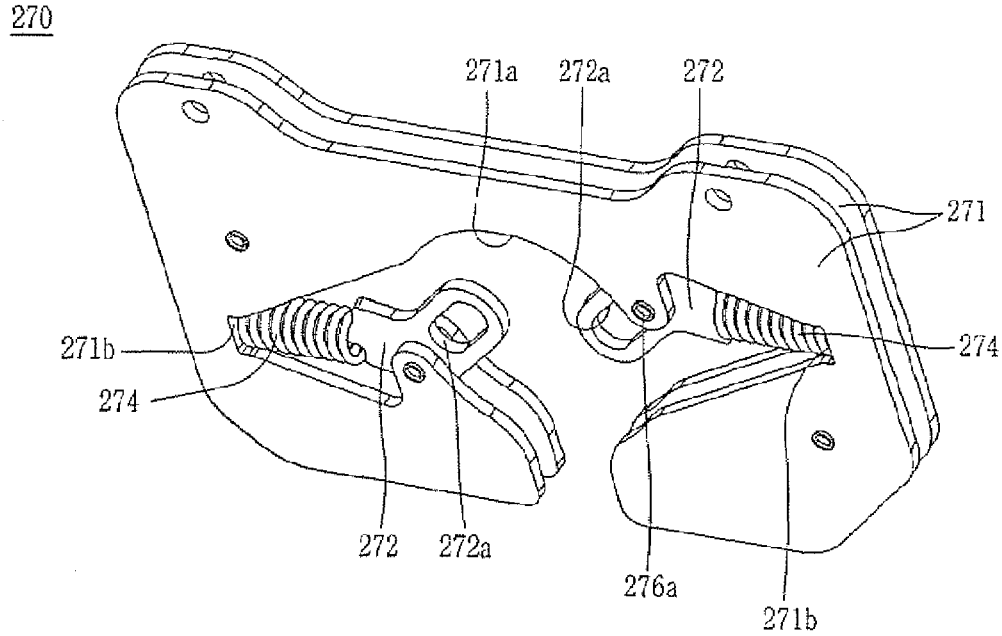
FIGS. 14 and 15 are a perspective view and front view, respectively, showing an auxiliary mechanism in accordance with another embodiment of the present invention.
Figure 15:
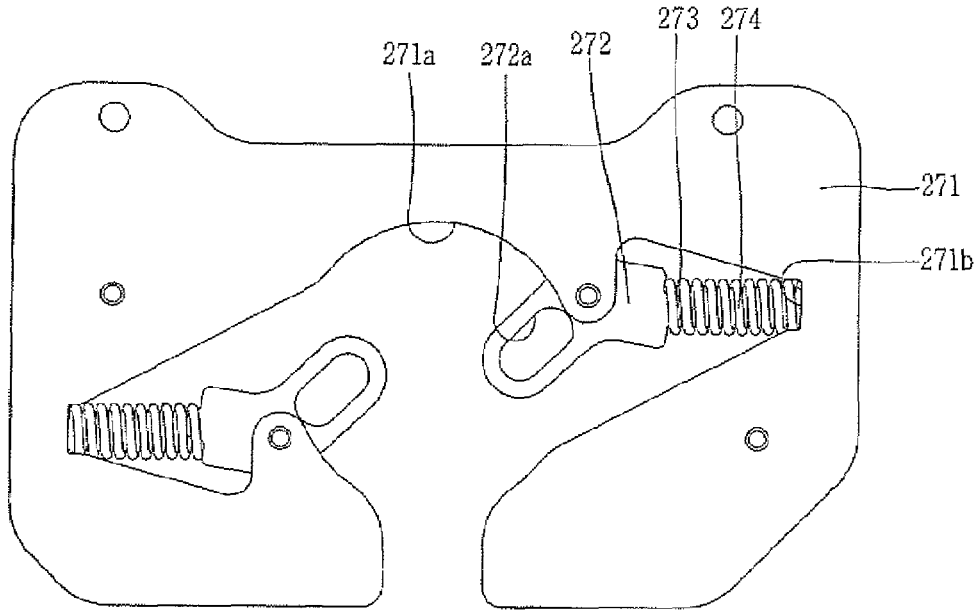

FIGS. 14 and 15 are a perspective view and front view, respectively, showing an auxiliary mechanism in accordance with another embodiment of the present invention.

Referring to FIGS. 14 and 15, the multi-pole circuit breaker in accordance with another embodiment of the present invention will be described below. Like reference numerals are given to constituent components like to those described in the aforesaid one embodiment of the present invention, and a detailed description thereof will be omitted.

The multi-pole circuit breaker in accordance with another embodiment of the present invention includes an auxiliary mechanism 270 that is operated in conjunction with the operation the above-described switching mechanism 150, and provides a compensating rotation moment to the driving shafts 152.

The auxiliary mechanism 270 includes a pair of substrates 271 fixedly disposed between the N-phase single pole breaking unit 110*d* and the T-phase single pole breaking unit 110*c*, and spaced apart a predetermined gap along the thickness direction by having through portions 271*a* penetrated along the thickness direction into a predetermined shape so as to pass the driving shafts 152 through, coupling links 272 relatively rotatably coupled to the substrates 271 so as to have an axial line along the thickness direction by having guide slots 272*a* for relatively rotating the driving shafts 152 and slidably receiving them, and springs 274 disposed between the coupling links 272 and the substrates 271 for providing an elastic force to the coupling links 272.

At this time, the substrates 271 and the coupling links 272 are relatively rotatably coupled to each other via typical hinge pins 276*a*.

Spring receiving portions 271*b* for receiving and supporting one ends of the springs 274 are formed at the substrates 271, respectively. Spring supporting portions 273 are protruded from the coupling links 272 so as to connect and support the other ends of the springs 274. The spring receiving portions 271*b* may be comprised of depressed portions formed at a width almost equal to the diameter of the springs 274, or spring seats additionally having projections protruded from the depressed portions in order to prevent the springs 274 from falling out.

Further, if the circuit breaker is switched from the ON state to the OFF state, the critical rotation points of the coupling links 272 are set in such a manner that the intervals rotated by the elastic force of the springs 274 are relatively longer than the intervals pressurized and rotated by the driving shafts 172.

By the above construction, the rotation driving force applied from the switching mechanism 150 to the single pole breaking units 110*a*, 110*b*, 110*c*, and 110*d* by the auxiliary mechanism 150 in accordance with another embodiment of the present invention can he applied in balance, and the single pole breaking unit for a neutral electrode serving as a ground system is input first at the time of power input, and the single pole breaking unit for a neutral electrode serving as a ground system is disconnected (cut off) last at the time of tripping.

As seen from above, according to the multi-pole circuit breaker in accordance with the present invention, it is possible to ensure the reliability of the switching operation between the contactors in the single pole breaking unit relatively far from the switching mechanism in the multi-pole circuit breaker, and the contact force between the contactors in the single pole breaking unit for each phase when applying current is balanced, thereby overcoming the problem of heat generation caused by incomplete contact between the contactors.

What is claimed is:

1. A multi-pole circuit breaker, which includes: a plurality of single pole breaking units having a pair of fixed contactors, a movable contactor rotatable to a contacted position to fixed contactors or a separated position from the fixed contactors, and shafts for rotatably supporting the movable contactor; a switching mechanism disposed on one of the plurality of single pole breaking units in order to provide a rotation force to the shafts; and a pair of driving shafts commonly connected to the shafts in order to simultaneously transmit a rotation force from the switching mechanism to the shafts of the plurality of single pole breaking units, comprising:

a substrate disposed between the single pole breaking units that do not include the switching mechanism, spaced relatively far from the switching mechanism as compared to the other single pole breaking units among the plurality of single breaking units, and the adjacent single pole breaking unit;

a link mechanism rotatably supported on the substrate, for providing a compensating rotation moment to the driving shafts so that a contact force between the contactors in the single pole breaking unit relatively far from the switching mechanism may not be smaller than a contact force between the contactors in the other single pole breaking units; and springs having one ends supported by the substrate and the other ends supported by the link mechanism, for providing an elastic force to the link mechanism for the provision of the compensating rotation moment.

2. The multi-pole circuit breaker of claim 1, wherein the link mechanism comprises coupling links provided with guide slots for relatively movably receiving the driving shafts, and relatively rotatably coupled to the substrate so as to have an axial line along the thickness direction thereof, for directly providing to the driving shafts an elastic force from the springs used as a compensating rotation moment.

3. The multi-pole circuit breaker of claim 1, wherein the link mechanism comprises:

coupling links provided with guide slots for relatively movably receiving the driving shafts, and relatively rotatably coupled to the substrate so as to have an axial line along the thickness direction thereof, for providing the compensating rotation moment to the driving shafts; and a supporting link having one ends relatively rotatably coupled to the coupling links and the other ends relatively rotatably supported by the substrate, for providing an elastic force from the springs for rotation to the coupling links.

4. The multi-pole circuit breaker of claim 3, wherein the link mechanism further includes supporting members for supporting the other end of the supporting link so as to be rotatable relative to the substrate while supporting the other ends of the springs.

5. The multi-pole circuit breaker of claim 1, wherein an auxiliary mechanism having the substrate, the link mechanism and the springs are disposed between the single pole breaking units for a neutral electrode among the plurality of single pole breaking units and the adjacent single pole breaking unit for another electrode, and critical rotation points of the coupling links at which the rotation driving force of the coupling links is switched from the switching mechanism to the auxiliary mechanism are set, so that the single pole breaking unit for the neutral electrode is input earlier or later than the single pole breaking units for other electrodes.

6. The multi-pole circuit breaker of claim 2, wherein an auxiliary mechanism having the substrate, the link mechanism and the springs are disposed between the single pole breaking unit for a neutral electrode among the plurality of single pole breaking units and the adjacent single pole breaking unit for another electrode, and critical rotation points of the coupling links at which the rotation driving force of the coupling links is switched from the switching mechanism to the auxiliary mechanism are set, so that the single pole breaking unit for the neutral electrode is input earlier or later than the single pole breaking units for other electrodes.

7. The multi-pole circuit breaker of claim 3, wherein an auxiliary mechanism having the substrate, the link mechanism and the springs are disposed between the single pole breaking unit for a neutral electrode among the plurality of single pole breaking units and the adjacent single pole breaking unit for another electrode, and critical rotation points of the coupling links at which the rotation driving force of the coupling links is switched from the switching mechanism to the auxiliary mechanism are set, so that the single pole breaking unit for the neutral electrode is input earlier or later than the single pole breaking units for other electrodes.

8. The multi-pole circuit breaker of claim 4, wherein an auxiliary mechanism having the substrate, the link mechanism and the springs are disposed between the single pole breaking unit for a neutral electrode among the plurality of single pole breaking units and the adjacent single pole breaking unit for another electrode, and the critical rotation points of the coupling links at which the rotation driving force of the coupling links is switched from the switching mechanism to the auxiliary mechanism are set, so that the single pole breaking unit for the neutral electrode is input earlier or later than the single pole breaking units for other electrodes.

* * * * *